United States Patent [19]

Riley et al.

[11] Patent Number: 5,074,997

[45] Date of Patent: Dec. 24, 1991

[54] FILTER AND PROCESS FOR MAKING A FILTER FOR DISPERSING INGREDIENTS INTO EFFLUENT

[75] Inventors: Michael D. Riley, Santa Monica; Victor L. Inman, Orangevale; Robert D. Athey, Jr., El Cerrito, all of Calif.

[73] Assignee: Riley and Wallace, Santa Monica, Calif.

[21] Appl. No.: 470,126

[22] Filed: Jan. 25, 1990

[51] Int. Cl.[5] ..... A47L 7/04

[52] U.S. Cl. ..... 210/97; 15/257 B; 55/270; 55/279; 55/DIG. 2; 106/15.05; 210/209; 340/607; 422/124; 512/2

[58] Field of Search ..... 15/257 B, 347, ; 55/279, 380, 381, 524, DIG. 3, DIG. 2, 270; 210/209, 97, 193; 422/5, 124, 294; 239/6; 512/2, 3; 106/15.05, 16, 22; 73/28.04; 340/606, 607

[56] References Cited

U.S. PATENT DOCUMENTS

| | | | |
|---|---|---|---|
| 3,371,984 | 3/1968 | Kelley et al. | 239/60 |
| 4,320,873 | 3/1983 | Martens, III et al. | 512/2 |
| 4,554,698 | 11/1985 | Rennecker et al. | 15/257 B |
| 4,675,347 | 6/1987 | Mochizuki et al. | 106/15.05 |
| 4,735,626 | 4/1988 | Smith et al. | 15/257 B |

FOREIGN PATENT DOCUMENTS

| | | | |
|---|---|---|---|
| 133590 | 11/1978 | Japan | 422/5 |
| 115705 | 9/1981 | Japan | 106/15.05 |
| 59-25754 | 2/1985 | Japan | 512/2 |
| 24073 | 8/1913 | United Kingdom | 55/279 |
| 533339 | 2/1941 | United Kingdom | 55/279 |
| 716450 | 10/1954 | United Kingdom | 55/381 |
| 2092296 | 8/1982 | United Kingdom | 55/279 |

*Primary Examiner*—Robert A. Dawson
*Assistant Examiner*—Joseph Drodge
*Attorney, Agent, or Firm*—Flehr, Hohbach, Test et al.

[57] ABSTRACT

A filter and method for applying differential levels of active ingredient materials to specific areas of filters, such as the filter paper used to make disposable vacuum cleaner bags, so as to cause the effluent such as air which has passed through such filters to sustainably act as a dispersing agent for such filter-impregnated active ingredients as may condition the effluent which has passed through the filter in ways that are desirable to the user of the filter. The active ingredients are unevenly distributed on the filter substrate in a pattern determined by predicted changing flow rate patterns through the area of the substrate during intervals of increasing accumulation of particulate matter against the filter and effective to maximally sustain dispersion of active ingredients during such intervals.

14 Claims, 2 Drawing Sheets

FILTER AND PROCESS FOR MAKING A FILTER FOR DISPERSING INGREDIENTS INTO EFFLUENT

BACKGROUND OF THE INVENTION

1. Field of the Invention:

The present invention relates generally to filters and their manufacture. It is particularly useful in increasing and extending the functional utility of air filters such as disposable vacuum cleaner bags, and it will therefore be described for example as it applies to these bags.

2. Description of the Prior Art:

Several products are available that let the users of vacuum cleaners add a more pleasant scent to the air that is filtered by their vacuum cleaners. All such products operate by means of adding a solid inclusion into the vacuum cleaner's dirt receptacle bag, whether by means of the users' placement of a perfume-impregnated tablet or strip directly into the bag, or by operating the vacuum so as to pull such a product or a perfumed powder into the bag. The extra expense and inconvenience of use of these products could be avoided if the disposable filter paper vacuum cleaner bags in most common use today could themselves be made to carry and dispense these perfumes or other active ingredients whose effects were desired by the user.

Previous efforts to develop disposable vacuum cleaner bags which would dispense such active ingredients as perfumes or reodorants into filtered effluents such as air have apparently encountered at least two difficulties: the requirement that the effective action of the active ingredients must be sustained over extended periods of time, and the unacceptably high expenses involved in uniformly applying the requisite high saturation levels of expensive active ingredients throughout the filter, or the expense of treating these ingredients in a manner that would acceptably prolong their effectiveness.

Others have shown how uniform application of a variety of chemical impregnation or polymer film treatments to the filter materials used in vacuum cleaner bags can improve the dust retention of the filter without increasing, or even reducing, the air resistance of the filter. Examples include U.S. Pat. Nos. 1,570,138, issued Jan. 19, 1926 to Gat; 2,251,252, issued to Lovell; 2,698,671, issued Jan. 4, 1955 to Kennette and Sumner; and published German Patent Application 2,940,712, dated Apr. 4, 1981, by Pfennig. U.S. Pat. No. 3,369,348, issued Feb. 20, 1968 to Davis, mentions that a vacuum cleaner's filter may be uniformly impregnated with chemicals to neutralize odors or irritants such as acidic particles which might be present as contaminants in the air which is filtered. U.S. Pat. Nos. 2,848,062 and 2,848,063, issued Aug. 19, 1958 to Meyerhoefer, shows how the air entering a vacuum cleaner bag has directional characteristics that may puncture or abrade specific portions of the interior surface of such a bag, and shows how abrasion-resistant, filtration-reducing barriers may be chemically or mechanically applied selectively to those portions of the interior of the bag most likely to be weakened, in order to extend its useful life. Other somewhat related prior art includes U.S. Pat. Nos. 4,116,648, issued Sept. 26, 1978 to Busch; 4,229,193, issued Oct. 21, 1980 to Miller; 4,749,386, issued June 7, 1988 to Strohmeyer et al. and published German Patent Application 2,835,260, dated Feb. 14, 1980 by Fischer.

None of these devices or teachings of prior art overcome the problems of extended filter ingredient durability and excessive expense discussed above, nor do they deal with economical methods of application or ingredient formulation.

SUMMARY OF THE INVENTION

The invention relates to a method for employing a filter to sustainably deliver an active ingredient, either into the material that has been restrained from passage by the filter or into the material effluent which passes through the filter. In the instant invention, active ingredients are applied to one or more exposed surfaces of a filter in a pattern that differentially concentrates the densest application of these active ingredients to specific areas of the filter which will be either in most prolonged use in filtering of the effluent medium into which the active ingredient is to be discharged, or to those areas which would otherwise be most likely to discharge material into the effluent which should be retained by the filter.

Accordingly, it is a primary object of this invention to provide a filter that will act as the vehicle for the controlled delivery of an active ingredient or ingredients into the material effluent of the filter over a sustained period of time.

It is a further object of this invention to provide a simple and cost effective methods of identifying the varying rates of flow of a filtered substance through different points and areas of either the inside or outside of a filter's exposed surfaces, at different times during the useful life of the filter, and to use these discoveries of filter-area-flow-rates to further cost-effectively identify optimal patterns for the selective application of treatment materials at differential rates of density or saturation to those areas of the filter where the treatment materials will be most durably effective.

Another object is to provide methods for the cost-effective application of fluids or particulate solids which contain active ingredients to either of a filter's surfaces, in patterns which have been identified as optimal for the prolongation of the effects of the active ingredients. The active ingredient might be an air deodorant or reodorant perfume, a bactericide or bacteriostat, an insecticide or repellant to deter or kill house mites or fleas and their eggs, a fungicide, or any other functional ingredient.

These and further objects and advantages of the present invention will become apparent to one of ordinary skill in the art in connection with the detailed descriptions of the preferred embodiments set forth in the following description of the invention, taken together with the drawings, in which:

DETAILED DESCRIPTION OF THE INVENTION

In accordance with the present invention, an active ingredient or ingredients are released from a filter into either the sedimentary filtered material which the filter has confined from passage into the effluent substance, or into the effluent material which has passed through the filter. The active ingredient can be defined as a functional. ingredient or as an ingredient which is released from the material of the filter to perform some function. Thus, for example, when the active ingredient is used primarily to perfume, reodorize or deodorize the air passing through the filter paper of a disposable vacuum cleaner bag, the active ingredients might comprise essential oils (such as pine oil, thyme oil, or lemon oil), while necessary but secondary functions might call for inclusion of such ingredients as flame retardant antioxidation agents to prevent spontaneous combustion of these oils (such as organic salts: ammonium sulfamate, zinc borate, antimony oxychloride; chlorinated organic compounds, such as chlorendic anhydride, alumina trihydrate, organic phosphates and phosphonates), food preservative agents to prevent rancidification of the essential oils (such as calcium propionate, calcium disodium EDTA, sodium benzoate, sodium tripolyphosphate, sodium phosphate, citric acid, ascorbic acid, BHA, and BHT), anti-bacterial, bactericidal, or bacteriostatic agents to further retard the rancidification of the essential oils (such as phenolic compounds, alcohols, aldehydes such as formaldehyde, propionic and benzoic acids, halogenated compounds including chlorine, hypochlorite, and iodine, salts of such metals as copper and mercury, including organic mercurials, and surfactants like benzalkonium and cetylpyridinium), other stabilizers and extenders of the oil (such as dyes, drying oils like soybean and cottonseed, mineral oils such as dipropylene glycol, petrolatum and glycerine, and alcohols), or any compound or solution of these ingredients. An active ingredient might be a bacteriostatic or antibacterial agent such as pine oil or thyme oil which is applied to the interior surface of a filter such as a vacuum cleaner bag on or in those areas of the bag most likely to be in contact with retained materials such as dust and dirt which have an objectionably high concentration of, or propensity to encourage the growth of, bacteria.

Figure 1:
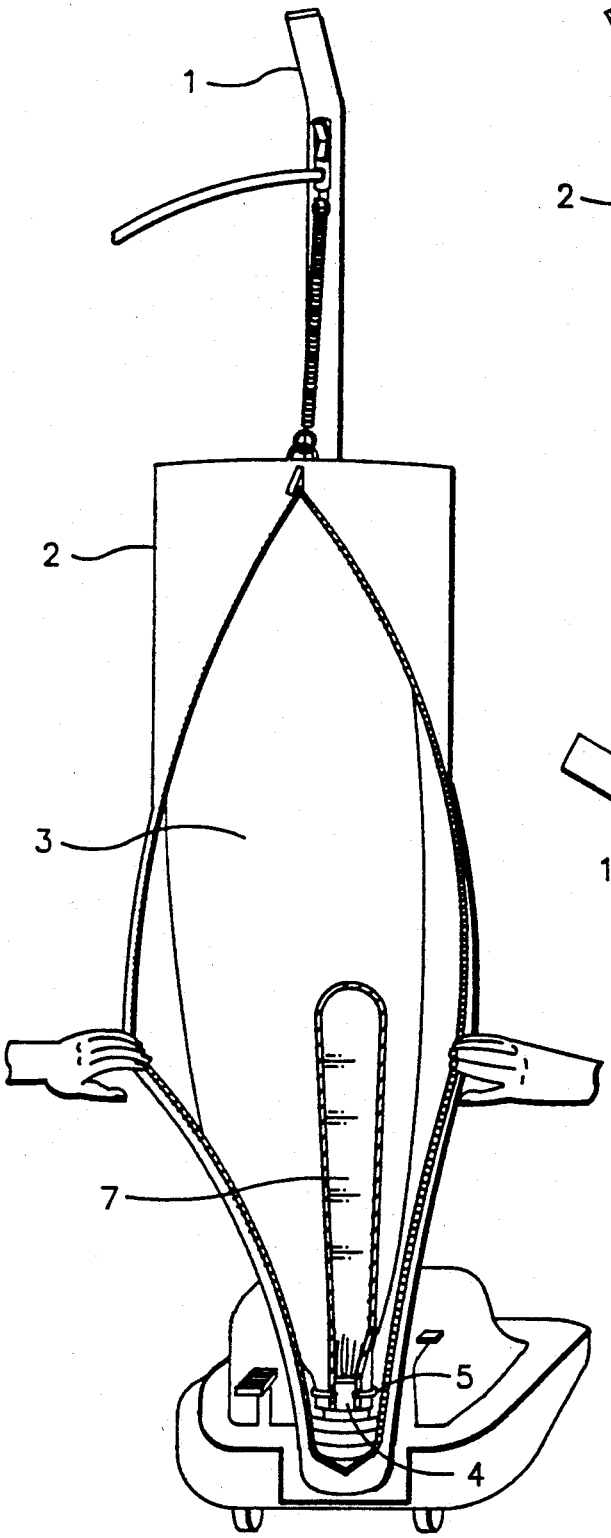
FIG. 1 is a rear view of an upright vacuum cleaner not in operation, with the protective cover over the disposable paper vacuum cleaner bag unzipped and held open to show that this bag is filled from its bottom up, and a cutaway view of the interior of the empty bag.
Figure 2:
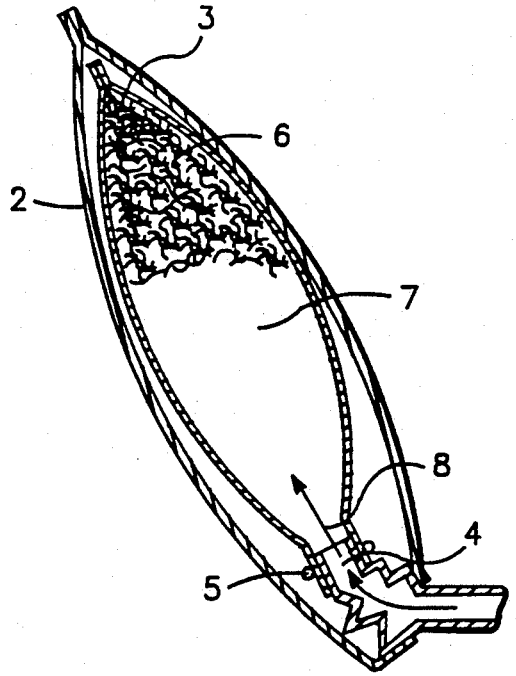
FIG. 2 is a cutaway view from the right hand side of the bag section of the same type of vacuum cleaner as is shown in FIG. 1, with the vacuum cleaner in operation and the bag approximately one-quarter filled with dust and dirt; the pressure of the air entering the bag suspends the collected dirt at the top of the bag, despite gravity.
Figure 3:
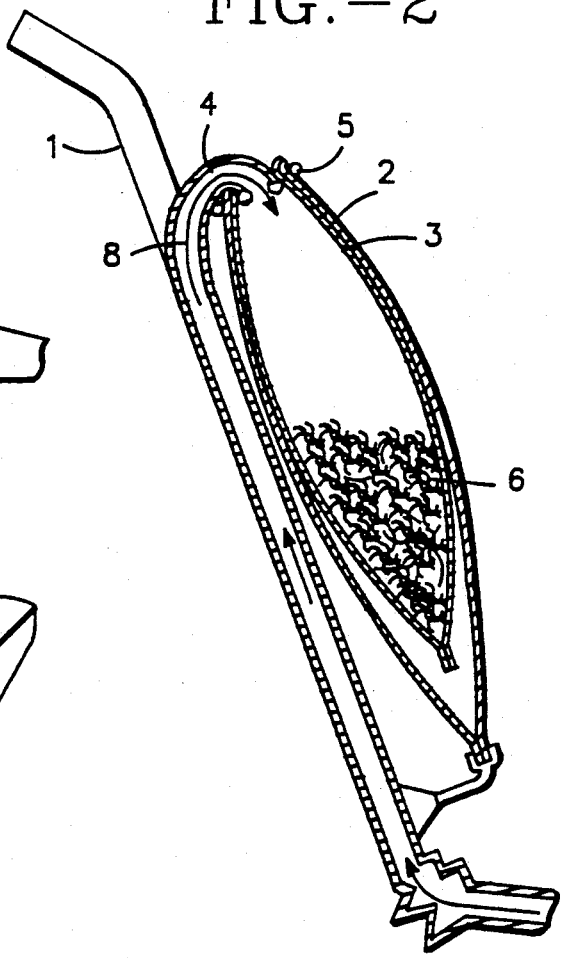
FIG. 3 is a cutaway view from the right hand side of the bag section of an upright, top-filling vacuum cleaner in operation, with the bag being approximately one third filled with collected dust and dirt.
Figure 4:
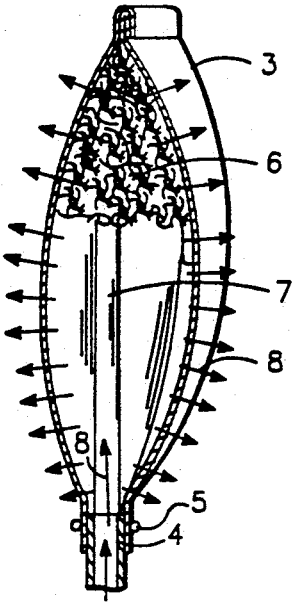
FIG. 4 is a cutaway view of the right hand side of a vacuum cleaner bag of the sort shown in FIG. 1, with the vacuum cleaner the bag is attached to in use, and with the bag being approximately one-quarter full of collected dust and dirt; air flow arrows are shown to suggest the rate of passage of air effluent from the bag in those portions of the bag in which the dirt is held and in those portions of the bag which are still empty.
Figure 5:
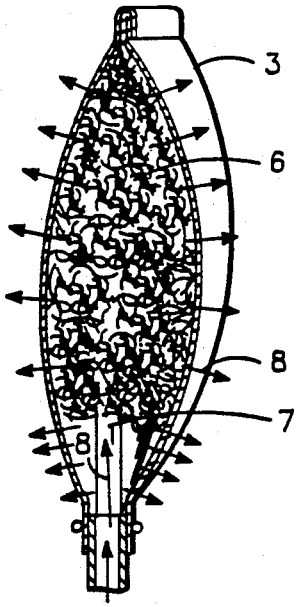
FIG. 5 is a cutaway view of the right hand side of a vacuum cleaner bag of the same sort as shown in FIG. 4, with the bag being approximately three-quarters full of collected dust and dirt, and arrows showing the rates of passage of effluent air.

Turning now to the drawings on a descriptive basis, with similar reference characters denoting the same or similar elements in all of the several views, FIGS. 1 through 5 illustrate disposable filter paper vacuum cleaner bags 3, both not in operation in FIG. 1 and in use in FIGS. 2 through 5, on different types of vacuum cleaners 1 in FIGS. 2 and 3, and in different degrees of fullness with contents of filtered material 6 in FIGS. 4 and 5.

Contemporary vacuum cleaners 1 from a variety of manufacturers employ a variety of configurations of disposable filter paper vacuum cleaner bags 3, with design configurations that will vary dependant on such factors as whether the vacuum cleaner employing the bag 3 is an upright 1 or canister style vacuum cleaner configuration, and if an upright design 1, then whether the dust and dirt 6 is top-filled as shown by flow 8 in FIG. 3 into the bag 3 or is blown up as shown by flow 8 in FIG. 1 into the bag 3. Air containing this dust and dirt 6 is directed into the interior 7 of the bag 3 through a tube 4 which extends from the impeller of the vacuum cleaner 1. The pressure of the air injected into the bag 3 from the tube 4 is greater than atmospheric pressure, which causes the air in the bag's interior 7 to escape as an effluent flow 8 (FIGS. 4 and 5) from the bag 3 by passing through the porous filter material of the bag 3. The bag is retained by the tube by means of a restraining ring 5 or other bag-positioning device. The pattern of pressures and rates of flow of air effluent 8 from the bag 3 will be contingent on a variety of factors, including: the amount of dirt 6 retained in the bag 3; the air flow impedances or resistance imposed by the shape and size of the chamber or container 2 in which the bag is retained; the design of the vacuum cleaner 1; the degree of coarseness and fibrous content of the dirt and other materials the bag contains after it has been in use; the weight, thickness, and porosity of the filter paper material; and the pattern of construction of the bag 3 itself.

As the first step in establishing a pattern for application of an active ingredient on a surface of a filter, a method is needed to efficiently measure and record the pattern of the effluent's passage through the filter material 8, and the varying rate of its discharge from each portion of the filter's surface area. To this end, a most efficient means for doing so in the case of a vacuum cleaner 1 is to sprinkle a powdered pigment such as carbon black loosely on a floor, and use a vacuum cleaner 1 in operation to blow this pigment into a vacuum bag interior 7, and into contact with the inner surface of the vacuum cleaner bag 3. The rate of contact and degree of retention of the powdered pigment with any given area of the inner surface of the vacuum cleaner bag will be proportional to the degree and rate of passage of effluent air 8.

Figure 6:
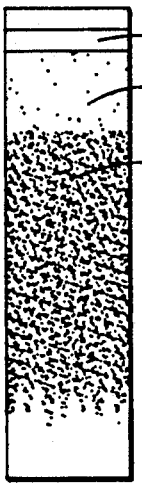
FIG. 6 is a cutaway view of a single panel of the interior of a vacuum cleaner bag as shown in FIG. 4, into which a powdered pigment has been drawn into the filter material of the bag by the normal operation of the vacuum cleaner, in order to serve as the first step in a method of this invention, the time and cost efficient disclosure of a pattern of effluent air flow through the filter material of a vacuum cleaner bag which already contains materials which have been restrained from entering the effluent air by the filter.

Consequently, a vacuum cleaner bag 3 that is one-third full of dirt as in FIG. 4 will produce a pattern of retained pigment on any one panel of its inner surface as shown in FIG. 6 that reveals the rate of passage of air from all areas of the vacuum cleaner bag 3 when it was in operation in the condition of being one-third full. The densest degree of pigment deposition will be found in those areas 10 in which the rate of flow of effluent air through the bag 8 was greatest, because no dirt is in the way of the passage of the air.

Figure 7:
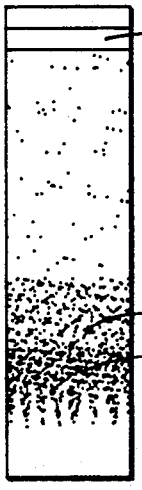
FIG. 7 is a cutaway view of a single panel of the interior of a vacuum cleaner bag as shown in FIG. 5, into which a powdered pigment has been drawn into the filter material of the bag by the normal operation of the vacuum cleaner, as in FIG. 6.

Likewise, a vacuum cleaner bag 3 that is three-quarters full of dirt as in FIG. 5 will produce a different pattern of retained pigment on the inner surface of a test bag as shown in FIG. 7. Here again the densest pigment deposits will be in areas 10 in areas where no dirt impedes the passage of the effluent air; it should be noted, however, that some air still passes through the material of the filter in those areas 11 where the air is pre-filtered through the retained dirt before it passes into and through the material of the filter.

Once such patterns of pigment retention have been recorded for vacuum cleaner bags 3 of any given configuration in a variety of different test conditions and in various degrees of fullness, their patterns can be superimposed if judgment suggests it is desirable to fabricate a filter that will dispense an active ingredient in a manner suited to a range of operating conditions. Means for mechanically obtaining such superpositioned patterns include multiple exposures of a photographic plate which will be used to make a printing plate or master pattern or die, each such photographic exposure being to a differently used vacuum bag's interior after this surface has been exposed by being opened and laid flat in a uniformly consistent position. The photopositive of such a "collective/accumulative image" photographic plate could then be used to make a printing plate for the deposition of the desired "averaged" pattern.

Figure 8:
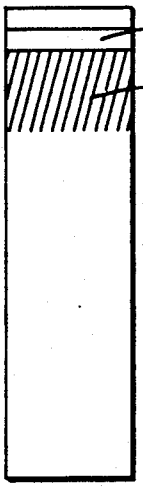
FIG. 8 is a view of a single exterior or interior panel of a vacuum cleaner bag which has been treated with an active ingredient in accordance with this invention, in a manner designed to counter the influence of any unfavorable properties of the effluent air which has passed through the material inside of the bag, which the filter has trapped and retained to the level shown in FIG. 4, and as disclosed by the pigment pattern shown in FIG. 6.
Figure 9:
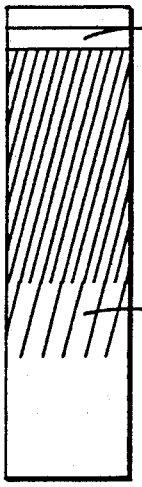
FIG. 9 is a view of a single exterior or interior panel of a vacuum cleaner bag which has been treated with an active ingredient in accordance with this invention, as in FIG. 8 in a manner designed to counter the influence of any unfavorable properties of the effluent air which has passed through the material inside of the bag, which the filter has trapped and retained to the level shown in FIG. 5, and as disclosed by the pigment pattern shown in FIG. 7.
Figure 10:
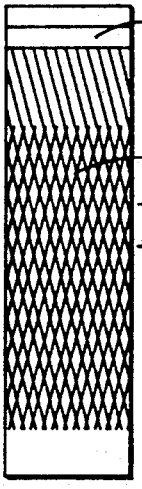
FIG. 10 is a view of single exterior or interior panel of a vacuum cleaner bag which has been treated with an active ingredient in accordance with this invention, in a manner designed to maximally sustain the rate of flow of the active ingredient into the air effluent from the bag after the bag has become one-quarter filled with retained filtrate dust and dirt, as shown in FIG. 4 and as disclosed by the test method shown in FIG. 6.
Figure 11:
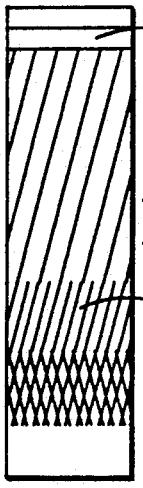
FIG. 11 is a view of single exterior or interior panel of a vacuum cleaner bag which has been treated with an active ingredient in accordance with this invention, in a manner designed to maximally sustain the rate of flow of the active ingredient into the air effluent from the bag after the bag has become three-quarters filled with retained filtrate dust and dirt, as shown in FIG. 5 and as disclosed by the test method shown in FIG. 7.

The determination of the pattern of application of an active ingredient to a surface of a vacuum cleaner bag 3 is subject to judgment in two further key respects: (1) whether the pattern will counter the effects or influence the contents of the material contained within the bag, or will only inject an active ingredient into the air effluent 8 from the bag 3; and (2) whether the ingredient is to be applied to the interior surface of the bag or to its exterior. These judgments are related by the fabricator's objectives; for example, if it is desired to have the bag's active ingredients overcome the growth of bacteria in the dirt contained within the bag and by that means to reduce the amount of undesirable odors injected into the effluent air after emerging from the dirt in the bag, then one would elect to apply the active ingredients to the interior surface of the bag, in patterns designed to concentrate the heaviest levels of the active ingredient in those areas where the dirt will be in contact with the interior surface of the bag. In this instance, the pattern of application of the active ingredient would be inversely proportional to the density of the retention of the test pigment in those areas 11 of the test surfaces adjacent to the dirt in the interiors of the test bags, such as is shown in patterns 12 and 13 of FIGS. 8 and 9. Such a pattern can be readily derived by employing the photographic negative images to establish the pattern of application on a printing plate to be used to deposit the active ingredient.

Alternatively, the fabricator of the bag 3 may wish to simply have the bag dispense its active ingredient into the effluent 8 in a durably sustained fashion. In that event, the pattern 14 and 15 of application of the active ingredient would be most concentrated in those areas of the bag 3 where air will be emerging most readily after the bag 3 has been in use for a time, and has acquired enough dirt and "cake" on the interior surface of the bag 3 to act as a partial block to the ready emergence of effluent air 8 in areas where the pattern of application will be more diffuse.

In accordance with this invention, the method of deposition of the active ingredient will be determined by the composition of the substance in which the active ingredient is contained; for example, whether it will be more effective to apply this substance containing the active ingredient in a liquid or in a solid form. In the event that a perfume is to be embedded in a plastic resin, for example, as a means of extending the durability of the exudation of this scent, the plastic resin could be powdered, mixed with an electromagnetically or electrostatically charged "toner", and deposited on the filter paper in the desired, predetermined pattern, by means of use of a rotating drum with a suitably charged surface in contact with a "web" or roll of unformed filter paper or fabricated bags that are variably heated by heating elements or infrared lamps or that are scanned by a laser in accordance with the desired pattern, in order to melt the plastic resin sufficiently to cause it to bond to the surface of the filter paper, having first been "dusted" with the toner-and-ingredient powder formulation. One of the additional benefits such an application of polymers to the fibers of the filter paper of the vacuum bag would be the capability to improve the rate of filtration of the bag, that is, to increase ability of the treated areas of the bag to prevent particles of dust and dirt from leaving the bag by reducing the sizes of the interstices between fibers of the bag through which the effluent must pass.

In the event that the active ingredient can be applied to the filter paper of the vacuum cleaner bag as a component of a liquid substance, the devices used to apply this substance could include common printing presses of all kinds, including letterpress, offset, rotogravure, or lithographic. The desired pattern of application of the active ingredient would, in this instance, be delivered by embedding this pattern in the printing plate. Alternatively, this liquid substance could be delivered to the surface of the filter paper by spray valves under computer-automated control, or by similar "ink-jets". In addition, when two or more active ingredients are to be applied in two different liquid substances, each in a different pattern to suit a different objective, both substances can be applied in one operation by means of use of a multi-color press, with the different ingredient-bearing substances each being applied as though it were a different color. In the case of perfumes used as active ingredients in such liquids, dyes, polymers such as acrylic or polystyrene with solubility parameters and chemical structures closely matched to that of the selected fragrance, and other stabilizers can be used to extend the effectiveness of these effluent-scenting ingredients.

Alternatively, an initial liquid layer can be applied to the filter paper as described, using a liquid containing one or a set of active ingredients which will dry to a "sticky" or "tacky" finish, by which means a powdered substance containing other active ingredients can be applied to the filter paper by means of passing the web of the paper through a pan or flow of the powder in a manner designed to cause some of the powder to adhere to the sticky portions of the surface of the filter paper, and to remove those remnants of the powder which are not affixed to the sticky surface. A suitable "sticky" formulation for such a liquid substance could include 100 grams of liquid depolymerized natural rubber, 5 to 10 grams of a suitable biocidal cationic emulsifier such as Alacsan 7LUF biocidal cationic emulsifier, and an antibacterial scenting ingredient such as 5 grams of pine oil, all stably emulsified in 400 grams of water using a high speed propeller. The application of the powder to the sticky surface would serve three purposes: (1) it would permit ingredients placed on the vacuum cleaner bag in the powder to serve additional purposes, or to perform similar purposes to the active ingredients in the sticky liquid which was previously applied to the bag, but perform these functions in different ways. As an example, both of the liquids could contain different but complementary scents; or (2) the powder could serve to mechanically impede the flow of effluents through the bag, thus improving the bag's ability to retain particles of dust and dirt. Or (3) the powder could prevent the sticky surfaces of the paper from adhering one to the other in a manner that would decrease or eliminate the usefulness of the bag, by making it difficult to fold, package, or otherwise fabricate, without inducing undesired self-adherence.

The rate at which either a liquid or powdered substance applied to the filter paper material of a vacuum cleaner bag dispenses a perfume, deodorant or reodorant can be further controlled by the inclusion of microcapsules, microtubules, microspheres, polymer inclusions or other chemical time released vehicles in these substances prior to their application to the filter paper material.

Having fully described the present invention, it will be apparent from the above description and drawings that modifications in the specific compositions, procedures, methods and processes may be made within the scope of the invention. Therefore, the invention is not intended to be limited to the particular compositions, processes or methods except as may be required by the lawful scope of the following claims:

What is claimed is:

1. A filter which disperses an active ingredient into a fluid which passes through said filter over a sustained period of use, the fluid containing entrained particulate matter to be retained by said filter, comprising a filter substrate defining an area and being porous to flow of the fluid through said substrate and which will block flow of the entrained particulate matter, and at least one active ingredient capable of dispersion into the fluid applied to said filter substrate, said at least one active ingredient being unevenly distributed on said filter substrate in a pattern determined by predicted changing flow rate patterns through the are of said substrate during intervals of increasing accumulation of particulate matter against the filter and effective to maximally sustain dispersion of active ingredient during said intervals.

2. The filter of claim 1 which counteracts a tendency of the accumulated particulate matter in said filter to act as a source which disperses unwanted materials into the fluid, in which a densest or most concentrated application of the at least one active ingredient applied to and on said filter substrate is in a portion of the area defined by the filter substrate in which preferential flow of the fluid occurs after accumulation of the particulate matter in the filter.

3. The filter of claim 1 in which the uneven distribution of said at least one active ingredient is in varying densities over said filter substrate, such that the uneven distribution will maintain a substantially uniform dispersion rate of active ingredients over time in use of said filter.

4. The filter of claim 3 in which said at least one active ingredient comprises a plurality of active ingredients on the filter substrate in a plurality of layers of varying density patterns.

5. The filter of claim 4 in which said plurality of layers each include a first active ingredient and a second active or inert ingredient in solid, dry powdered from adhered to the first active ingredient.

6. The filter of claim 5 in which the first active ingredient comprises a rubber, a polar solvent and a cationic surfactant.

7. The filter of claim 6 in which the second active ingredient comprises a perfume, deodorant or reodorant.

8. The filter of claim 7 in which the perfume, deodorant or reodorant is in a time released vehicle wherein a dispensation rate of the perfume, deodorant or reodorant can be selectively enhanced or retarded.

9. The filter of claim 1 in which the active ingredient includes a stabilizer.

10. The filter of claim 9 in which the stabilizer is a dye.

11. The filter of claim 10 in which the at least one active ingredient is a perfume, deodorant or reodorant having a given solubility parameter and chemical structure and the stabilizer is a polymer with a solubility parameter and chemical structure which closely match the given solubility parameter and chemical structure.

12. The filter of claim 11 in which the stabilizer is a bacteriostat or bactericide.

13. The filter of claim 11 in which the at least one active ingredient is an essential oil and the stabilizer is an antioxidant.

14. The filter of claim 1 in which the uneven distribution is in a pattern covering less than all of said filter.

* * * * *